United States Patent [19]

Kühnert

[11] Patent Number: 4,555,917

[45] Date of Patent: Dec. 3, 1985

[54] COMBINED KNITTING-TRANSFER CAM UNIT FOR V-BED FLAT KNITTING MACHINES WITH SLIDER NEEDLES

[75] Inventor: Gottfried Kühnert, Aalen, Fed. Rep. of Germany

[73] Assignee: Universal Maschinenfabrik Dr. Rudolf Schieber GmbH & Co., KG, Westhausen, Fed. Rep. of Germany

[21] Appl. No.: 621,771

[22] Filed: Jun. 18, 1984

[30] Foreign Application Priority Data

Jul. 27, 1983 [DE] Fed. Rep. of Germany ..... 3327093

[51] Int. Cl.[4] ..... D04B 15/36

[52] U.S. Cl. ..... 66/78; 66/64; 66/70

[58] Field of Search ..... 66/64, 78, 70, 76, 60 R

[56] References Cited

U.S. PATENT DOCUMENTS

| | | | |
|---|---|---|---|
| 3,615,145 | 10/1971 | Goller et al. | 66/78 |
| 3,693,377 | 9/1972 | Hadam | 66/78 |
| 4,012,927 | 3/1977 | Kuhnert | 66/78 |
| 4,154,067 | 5/1979 | Grimmer et al. | 66/78 |
| 4,287,727 | 9/1981 | Otoshi | 66/78 |
| 4,463,579 | 8/1984 | Schimko et al. | 66/78 |
| 4,470,274 | 9/1984 | Shima | 66/78 |
| 4,474,037 | 10/1984 | Kühnert | 66/64 |

FOREIGN PATENT DOCUMENTS

| | | |
|---|---|---|
| 215585 | 6/1961 | Austria . |
| 705199 | 3/1941 | Fed. Rep. of Germany . |

*Primary Examiner*—Ronald Feldbaum
*Assistant Examiner*—Mary A. Ellis
*Attorney, Agent, or Firm*—Sughrue, Mion, Zinn, Macpeak and Seas

[57] ABSTRACT

A combined knitting-transfer cam unit for V-bed flat knitting machines with selectively choosable slider needles whose sliders are also designed for the transfer of stitches comprises stationary and movable cam elements for engagement with the needle butts and the slider butts, as well as pressure cam elements for the selection of needles. In order to be able to carry out any combination of knitting processes or transfer processes for each carriage traverse, and in order to achieve a compact cam unit, one knitting cam unit and two transfer cam units are arranged symmetrically, in the knitting cam unit there are provided cam elements for automatic pendular movement and a longitudinally displaceable cam element, cam elements movable in the plane of the cam unit and out of the plane of the cam unit are provided for knitting and transfer and cam elements are provided displaceable in the longitudinal direction of the needles, cam elements are provided movable in the plane of the cam unit and out of the plane of the cam unit for the acceptance of stitches, and three selection positions are provided for the choice of needles for the formation of tuck loops, for the formation of stitches or for the donation of stitches and for the acceptance of stitches.

4 Claims, 9 Drawing Figures

COMBINED KNITTING-TRANSFER CAM UNIT FOR V-BED FLAT KNITTING MACHINES WITH SLIDER NEEDLES

Background to the invention

This invention relates to a combined knitting-transfer cam unit for V-bed flat knitting machines, wherein needle butts of the needle bodies of slider needles are selectively lowerable in the needle channels of the needle beds by means of a needle selection device, wherein the slider needles have sliders provided with slider butts and arranged for the donation of stitches, wherein stationary and movable cam elements are provided for engagement with the needle butts and the slider butts, and wherein pressure cam elements are provided cooperating with the needle selection device.

One such knitting-transfer cam unit is known for example from German published patent application DE-OS No. 22 28 547. This known knitting-transfer cam unit comprises movable cam elements both for the needle butts and also for the slider butts, and makes possible, in one carriage traverse, the formation of stitches, the formation of tuck loops, the donation of stitches from the front needle bed to the rear needle bed or the donation of stitches from the rear needle bed to the front needle bed.

Other cam units for knitting machines with latch needles are known, with the cam units arranged next to each other, but only capable of knitting or of stitch transfer. Furthermore, such cam units are known which are arranged below one another and operate with double-butt needles. A combined knitting-transfer double-cam unit for latch needles is also known, by means of which one can only transfer stitches in one direction with the particular leading cam unit, for example stitches advancing from right to left forwards and stitches advancing from left to right rearwards.

SUMMARY OF THE INVENTION

It is an object of the present invention to provide a simple and compactly constructed combined knitting and transfer cam unit of the type first referred to above, in which, for each carriage traverse, i.e. independently of the direction of traverse of the carriage, any combination of stitch formation and tuck loop formation or transfer of all or some stitches from the front needle bed to the rear needle bed or vice versa can be accomplished.

This is achieved in accordance with the present invention by the following combination of features:

(a) transfer cam units are arranged in advance of and following a knitting cam unit constructed symmetrically relative to its central transverse axis, said transfer cam units likewise being constructed symmetrically relative to the central transverse axis;

(b) the knitting cam unit comprises a cam element movable into operation in pendular manner relative to the central transverse axis at the positions of carriage reversal for engagement with the needle butts for the formation of stitches, and also comprises a cam element displaceable at the positions of carriage reversal along the cam unit relative to the central transverse axis for engagement with the slider butts for the formation of stitches;

(c) at each transition between knitting cam unit and transfer cam unit there is provided a cam element movable perpendicular to the plane of the cam unit for engagement with the slider butts for the donation of stitches and, at each same position, a cam element movable in the plane of the cam unit perpendicular to the direction of movement of the cam unit for engagement with the slider butts for the formation of stitches;

(d) in each transfer cam unit there is provided a stationary cam element for engagement with the slider butts for the donation of stitches and a cam element movable perpendicular to the plane of the cam unit for engagement with the needle butts for the acceptable of stitches; and (e) on the central transverse axis of the knitting cam unit there is a selection position for the needle butts for the formation of tuck loops and, in advance of and following this position, respective selection positions for the needle butts for the formation of stitches or donation of stitches and for the acceptance of stitches. Preferably, the cam elements for engagement with the slider butts define slider butt channels limited at both ends in the direction of the slider longitudinal axis; this ensures a particularly reliable operation of the sliders.

The cam element for engagement with the needle butts for the formation of stitches and a cam element for engagement with the needle butts for the formation of tuck loops are preferably mounted on a common plate which is movable in pendular manner.

A preferred embodiment of the invention has a plurality of knitting cam units with a transfer cam unit arranged between each pair, the transfer cam unit being symmetrical relative to its own central transverse axis, and with three selection positions for each knitting cam unit. By this means the combined knitting-transfer cam unit of the present invention performs as a compact multiple-cam unit in an extraordinarily simple way.

BRIEF DESCRIPTION OF THE DRAWINGS

The invention will now be more fully described with reference to preferred embodiments thereof and with reference to the accompanying drawings. In the drawings.

DESCRIPTION OF THE PREFERRED EMBODIMENT

The embodiment of combined knitting-transfer cam unit for slider needles shown in FIGS. 1 and 3 to 6, serves for the control of the needle bodies and to control the sliders of the slider needles in the formation of stitches and in the formation of tuck loops, as well as in the combination of both types of knitting in the three-way technique (stitch, tuck, no-knit), or in the donation and acceptance of stitches during a course of knitting, i.e. with a traverse of the carriage from left to right or from right to left.

The combined knitting-transfer cam unit according to this embodiment consists, for each needle bed, of a knitting cam unit S constructed to be symmetrical with respect to its central transverse axis M, and transfer cam units U1 and U2 arranged to lead and trail the knitting cam unit, the two transfer cam units likewise being constructed to be symmetrical as a pair with respect to the central transverse axis M. Each cam unit comprises a cam zone A for the control of the needle bodies, a cam zone B for the control of the sliders of the slider needles, as well as a cam zone C for selective choice of needle.

Figure 1:
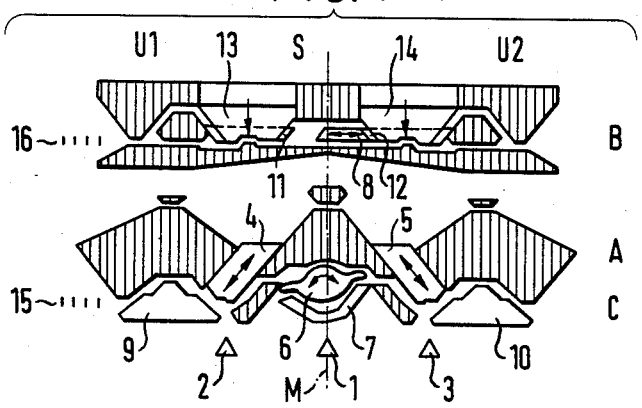
FIG. 1 shows an embodiment of combined knitting and transfer cam unit in accordance with the invention for a needle bed of a flat knitting machine, the cam unit being formed as a single-cam unit.
Figure 2:
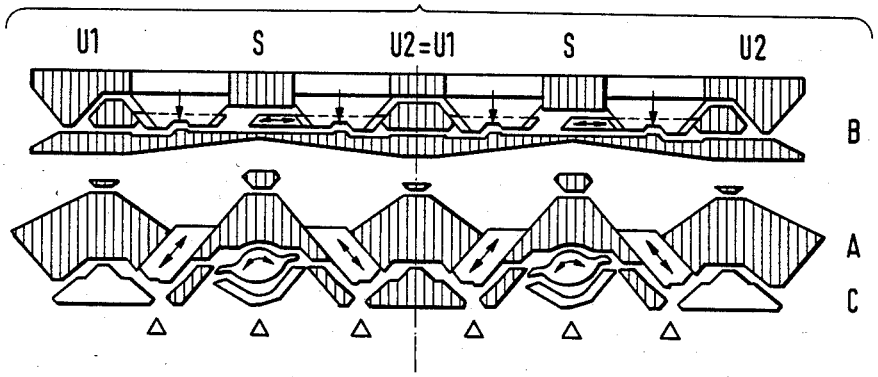
FIG. 2 shows an embodiment similar to FIG. 1, but formed as a double-cam unit.

Since the combined knitting-transfer cam unit is fully symmetrical, a number of them can be arranged next to each other and consequently be formed as a double-cam unit, triple-cam unit, quadruple-cam unit or multiple-cam unit. Thus, only one transfer cam unit U may be provided between successive knitting cam units S, and the transfer cam unit for its part is symmetrical with respect to its own central transverse axis. FIG. 2 shows an embodiment in the form of a double-cam unit.

The choice of needle in the described combined knitting-transfer cam unit is carried out in such a way that the needle butts of the needles which should not be operative are lowered in the needle bed. All stationary cam elements which do not move are indicated by vertical cross-hatching. All cam units movable perpendicular to the plane of the cam unit are either shown without crosshatching (when displaced out of operation) or with oblique cross-hatching (when displaced into operation). All cam elements displaceable or movable in pendular manner in the plane of the cam unit are shown without cross-hatching and are provided with arrows.

In the cam zone C there is provided, on the central transverse axis of the knitting cam unit S, a selection position 1 for the choice of needles for the formation of tuck loops for both directions of carriage traverse. Additionally, selection positions 2 and 3 are provided leading and trailing the selection position 1 and arranged symmetrically with respect to selection position 1. With traverse of the carriage from right to left selection position 2 serves for the choice of the needles for the formation of stitches or donation of stitches and selection position 3 serves for the choice of the needles for the acceptance of stitches. With a traverse of the carriage in the reverse sense, from left to right, the functions of selection positions 2 and 3 are exchanged.

Cam elements 4 and 5 are needle sinkers displaceable in the plane of the cam in the direction of the arrows. Cam elements 6 and 7 in the knitting cam unit S sit jointly on a plate and are moved in a pendular manner automatically into their operational positions at the positions of carriage reversal. Cam element 8 in the knitting cam unit S is displaceable in the plane of the cam perpendicular to the central transverse axis M and is likewise displaced automatically into its operational position upon reversal of the carriage. Cam elements 9, 10 and 11, 12 are movable into and out of operation perpendicular to the plane of the cam. Finally, in the region of cam elements 11 and 12, there are provided cam elements 13 and 14 which are displaceable in the plane of the cam perpendicular to the direction of cam traverse movement.

Figure 6:
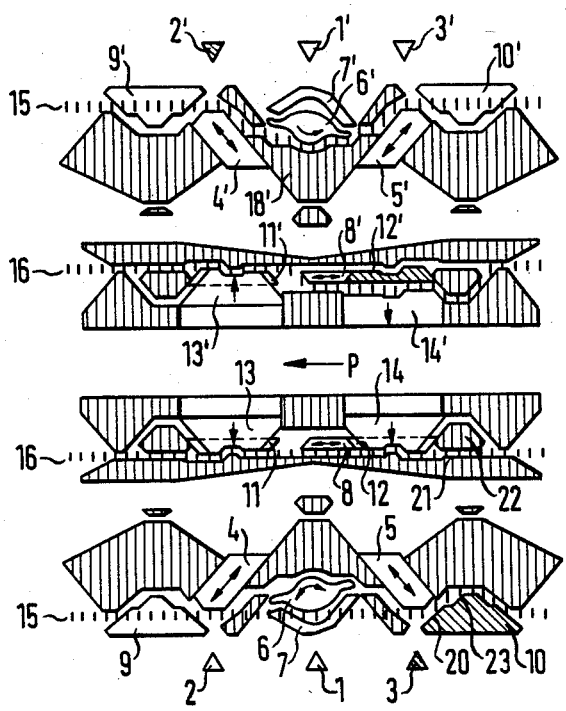
FIG. 6 shows a combined knitting-transfer cam unit as shown in FIG. 1 for both needle beds, set for the transfer of stitches from the needles of the rear needle bed to the needles of the front needle bed.

The needle butts of the slider needles are indicated at 15, and the slider butts of the sliders are indicated at 16. All the corresponding cam elements of the cam unit for the rear needle bed are shown with primed reference numbers (FIG. 6).

Figure 3:
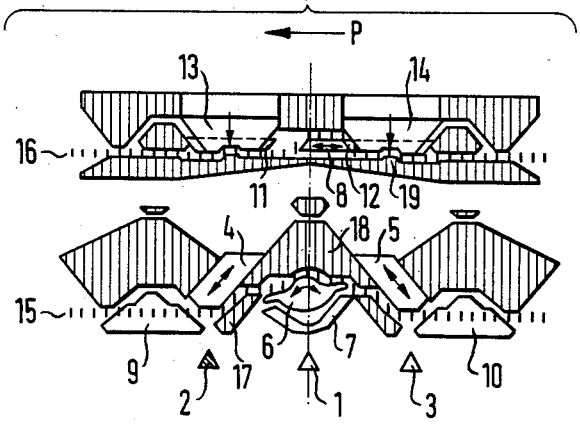
FIG. 3 shows the combined knitting-transfer cam unit of FIG. 1, set for the formation of stitches.

FIG. 3 shows the displaced position of the cam elements for the formation of stitches with a carriage traverse from right to left in the direction of the arrow P. Cam elements 6 and 7 are swung to the left in pendular manner, and cam element 8 is displaced to the right. Cam elements 9, 10 and 11, 12 are withdrawn into their positions in which they are out of operation, and cam elements 13 and 14 are displaced downwards. The slider butts 16 remain always in operation, while the needle butts 15 are raised from the needle bed at the selection position 2 which is in operation.

A stationary cam element 17 in the knitting cam unit S engages the needle butts 15 and, in combination with cam element 6 which has been swung into operation, takes them upwards, while the slider butts 16 are held down by cam element 13 sufficiently long until the needle hooks have opened. Thereafter, the sliders are brought by the needle bodies automatically to the fully raised or extended height. The slider needle remains in this position until, without relative movement between needle body and slider, it is withdrawn into the thread-laying position by a stationary cam element 18 in the knitting cam unit S. A stationary cam element 19 then raises or extends the slider to a certain degree, while cam element 5 pulls the needle body back. After the ending of this relative movement, i.e. when the needle hook is closed again, needle body and slider slide downwards corresponding to the set withdrawal depth of cam element 5, whereby the slider remains somewhat below the level-cam position, and the newly laid thread is formed only into new stitches.

Figure 4:
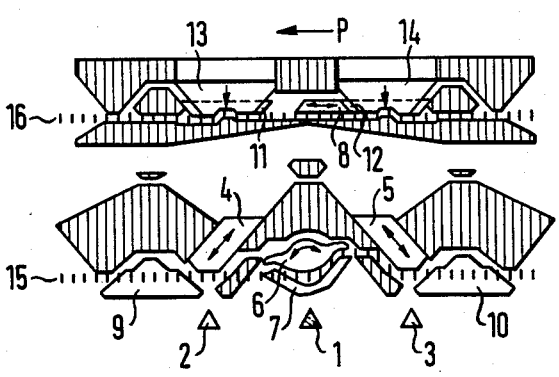
FIG. 4 shows the combined knitting-transfer cam unit of FIG. 1, set for the formation of tuck loops.

FIG. 4 shows the displaced position of the cam elements for the formation of tuck loops with a traverse of the carriage from right to left in the direction of the arrow P. The displaced position of the cam elements is the same as described above in connection with FIG. 3 for the formation of stitches, with the exception that selection position 2 is not in operation and instead of this the needle butts 15 are raised up from the needle bed at the selection position 1 which is in operation.

Cam element 7 which has been swung into operation thus extends or raises the slider needles by way of their needle butts 15, while displaceable cam element 8 holds the sliders back by their slider feet 16 until the needle hooks have opened. All further motions follow as in the case of stitch formation, but with the difference that the newly laid thread and the old stitch lie jointly in the needle hook and the newly laid thread is formed into the new tuck loop when the needle is withdrawn below the level-cam position.

Figure 5:
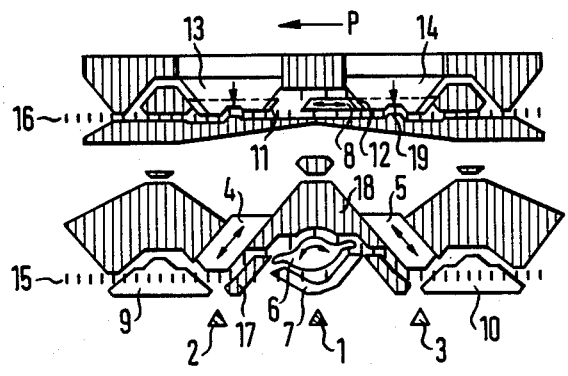
FIG. 5 shows the combined knitting-transfer cam unit of FIG. 1, set for knitting in the three-way technique (stitch, tuck, no-knit)

FIG. 5 shows the displaced position of the cam elements when knitting in the three-way technique with a carriage traverse from right to left in the direction of the arrow P. At selection position 2 the slider needles for stitch formation are chosen and at selection position 1 the slider needles for tuck loop formation are chosen. Those slider needles which should not knit remain in their basic positions in which the needle butts 15 remain lowered in the needle bed and cannot be engaged by the knitting cam unit.

FIG. 6 shows the displaced position of the cam elements for both the front and rear needle beds for the donation of stitches from the rear bed forwards with a traverse of the carriage from right to left in the direction of the arrow P. For the donation of the stitches cam elements 6' and 7' are swung to the left in the cam unit above the rear needle bed and cam element 8' is displaced to the right. Cam elements 9', 10' and 11' are pulled back into the position where they are out of operation, and cam element 13' is displaced downwards, i.e. into the same position as it occupies for the formation of stitches and tuck loops. Cam element 14' on the other hand is displaced upwards and cam element 12' is displaced into operation. Selection position 2' is active; selection positions 1' and 3' are inactive. As a consequence of this displacement of the cam elements the positioning of the donating needles is taken over by the knitting cam unit into the setting in which the needles, as for the extension of stitches, allow the stitches to slide from the opened needle head on to the needle slider.

The displaced position of the cam elements of the cam unit above the front needle bed for the acceptance of the stitches is the same as for the formation of stitches or tuck loops with the exception that cam element 10 is now displaced into an active position and selection position 3 for the raising of the needle butts 15 of the accepting needles from the needle bed is in an active position, while selection positions 1 and 2 stand inactive.

Figure 7:
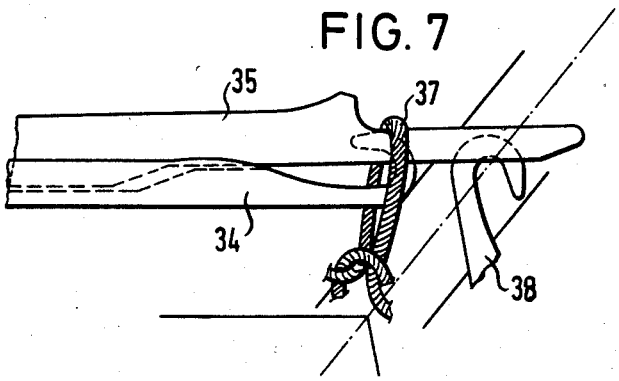
FIGS. 7 to 9 show different positions in the transfer of a stitch from a donor slider to an accepting needle.

At selection position 2' the rear slider needles which should pass the stitches forwards are chosen. Their needle butts 15 slide upwards on stationary cam element 17' 17', as for stitch formation, while the slider butts 16 are held by the cam element 13' until the needle heads have opened and the sliders have automatically been entrained by the needle bodies. When the position of maximum extension has been achieved, in which the stitches can slide on to the slider, the slider butts are held by cam element 8' and by cam element 12' which is in operation until the needle body has been withdrawn again to the level-cam position by cam elements 18' and 5' and until the opposing slider needle in the front needle bed has been raised to the threading level, as is shown in FIG. 7, after selection at selection position 3', by the edge 20 of cam element 10 which has been displaced into operation. The slider is prevented from rising by the lower edge 21 of stationary cam element 22, so that the needle hook is opened. In this position the slider needles in the front needle bed have their needle hooks threaded between the pairs of slider webs of the sliders of the slider needles in the rear needle bed. Upon further displacement the sliders of the donating needles in the rear needle bed are brought by stationary cam element 22' into the position shown in FIG. 8, so that the accepting needles can be extended or raised into the receiving position shown in FIG. 9 by the cam edge 23 of cam element 10. Upon further displacement, the donating sliders, as well as the receiving needles, are withdrawn into the basic position approximately corresponding to the level-cam position.

Figure 8:
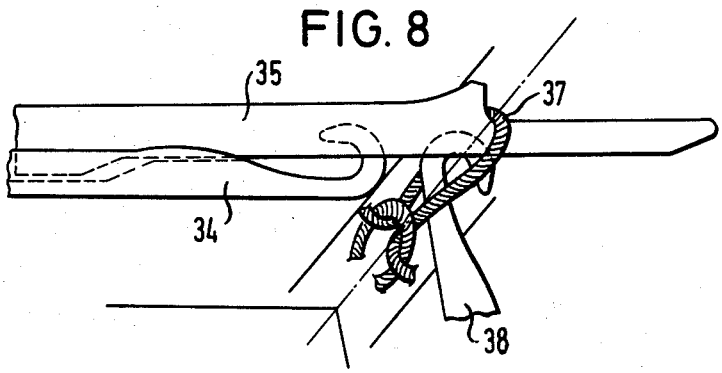
Figure 9:
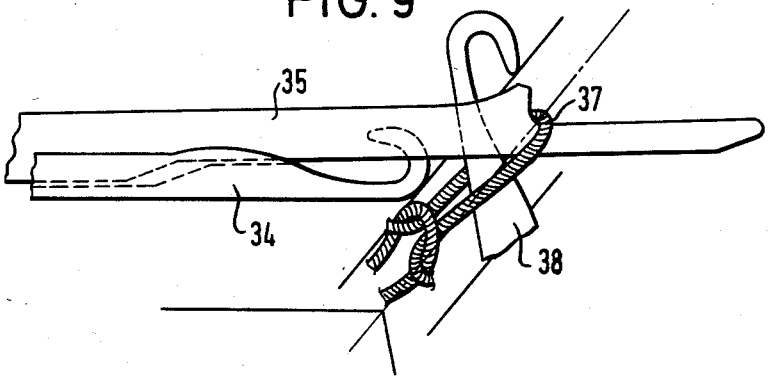

From FIGS. 7, 8 and 9, in which the slider needles (needle bodies) are indicated at 34 and 38, the slider is indicated at 35 and the stitch being transferred is indicated at 37, it is clearly seen that during the donation of the stitch 37 the slider webs of the donating slider 35 are held spread apart without difficulty by the needle hook and the needle body of the donating slider needle 34, so that the receiving slider needle 38 can move in without difficulty between the slider webs, as shown in FIG. 7. With further movement, as shown in FIG. 8, when bringing the stitch 37 forwards, the needle hook of the slider needle 38 is completely masked by the slider webs so that the stitch 37 can slide over the needle hook into the donating position without damage.

I claim:

1. A combined knitting-transfer cam unit for V-bed flat knitting machines, wherein needle butts of the needle bodies of slider needles are selectively lowerable in the needle channels of the needle beds by means of a needle selection device, wherein the slider needles have sliders provided with slider butts and arranged for the donation of stitches, wherein stationary and movable cam elements are provided for engagement with the needle butts and the slider butts, and wherein pressure cam elements are provided co-operating with the needle selection device, in which (a) transfer cam units are arranged in advance of and following a knitting cam unit constructed symmetrically relative to its central transverse axis, said transfer cam units likewise being constructed symmetrically relative to the central transverse axis;

(b) the knitting cam unit comprises a cam element movable into operation in pendular manner relative to the central transverse axis at the positions of carriage reversal for engagement with the needle butts for the formation of stitches, and also comprises a cam element displaceable at the positions of carriage reversal along the cam unit relative to the central transverse axis for engagement with the slider butts for the formation of stitches;

(c) at each transition between knitting cam unit and transfer cam unit there is provided a cam element movable perpendicular to the plane of the cam unit for engagement with the slider butts for the donation of stitches and, at each same position, a cam element movable in the plane of the cam unit perpendicular to the direction of movement of the cam unit for engagement with the slider butts for the formation of stitches;

(d) in each transfer cam unit there is provided a stationary cam element for engagement with the slider butts for the donation of stitches and a cam element movable perpendicular to the plane of the cam unit for engagement with the needle butts for the acceptance of stitches; and (e) on the central transverse axis of the knitting cam unit there is a selection position for the needle butts for the formation of tuck loops and, in advance of and following this position, respective selection positions for the needle butts for the formation of stitches or donation of stitches and for the acceptance of stitches.

2. A combined knitting-transfer unit according to claim 1, in which the cam elements for engagement with the slider butts define slider butt channels limited at both ends in the direction of the slider longitudinal axis.

3. A combined knitting-transfer cam unit according to claim 1, in which the cam element for engagement with the needle butts for the formation of stitches and a cam element for engagement with the needle butts for the formation of tuck loops are mounted on a common plate which is movable in pendular manner.

4. A combined knitting-transfer cam unit according to claim 1, in which a plurality of knitting cam units are provided, with a transfer cam unit arranged between each pair, the transfer cam unit being symmetrical relative to its own central transverse axis, and with three selection positions for each knitting cam unit.

* * * * *